US005542218A

United States Patent [19]

Rompel

[11] Patent Number: 5,542,218

[45] Date of Patent: Aug. 6, 1996

[54] STRUCTURAL SUPPORT FRAME FOR CERAMIC TILE CORNER SEATS AND SERVICE TRAYS

[75] Inventor: Wade D. Rompel, San Francisco, Calif.

[73] Assignee: Innovis Corporation, Novato, Calif.

[21] Appl. No.: 255,972

[22] Filed: Jun. 8, 1994

[51] Int. Cl.[6] ..... A47K 3/16

[52] U.S. Cl. ..... 52/34; 52/35; 52/385; 52/653.1; 4/611; 4/614

[58] Field of Search ..... 52/34, 35, 653.1, 52/385, 389; 4/548, 571.1, 573.1, 574.1, 584, 589, 590, 611, 612, 614; 248/220.1, 235

[56] References Cited

U.S. PATENT DOCUMENTS 2,828,044 3/1958 Reiss et al. ..... 248/220.1 X 4,557,004 10/1985 Piana ..... 4/612 X 4,771,488 9/1988 Markham ..... 52/35 X

*Primary Examiner*—Kien T. Nguyen

[57] ABSTRACT

A corrosion-resistant self-supported frame of a pre-formed shape, to which a mortar substrate and ceramic tile is applied, in order to produce corner seats and trays. The base unit (1) connects to vertical surfaces by fasteners through mounting holes (3). A mortar support flange (5) provides shape of bonding surfaces for ceramic tile as well as support for the applied substrate (**6*b*). The substrate (6*b*) is reinforced by mortar penetration holes (4), allowing monolithic connection of all substrate materials (6). A drain hole (2) allows for the elimination of moisture from the base unit (1**).

7 Claims, 2 Drawing Sheets

STRUCTURAL SUPPORT FRAME FOR CERAMIC TILE CORNER SEATS AND SERVICE TRAYS

BACKGROUND—FIELD OF INVENTION

This invention relates to ceramic tile seat supports and service trays used specifically with mortar-based applications for new and existing ceramic tile surfaces.

BACKGROUND—DESCRIPTION OF PRIOR ART

Homeowners, as well as businesses, frequently request "customization" of ceramic tile showers and tub areas. One of these customizations is based on a corner-mounted seat, or a self-supporting seat in tiled showers and Roman tub systems. However, many tile contractors who install these seats risk high liability because of product failure from several directions, as well as expend a great deal of costly labor to produce a finished product.

The current method of installation of these seats consists of a site-produced wood frame structure that is permanently mounted to the "rough" frame of a shower or tub wall, suspended diagonally, waterproofed with one of several various methods, reinforced with chicken wire or other means, and, then, has a sub-base or mortar applied to all exposed surface areas. Ceramic tile is then applied over the mortar by means of a bonding agent and grouted to match surrounding areas.

Although this provides an appealing finished product that serves a convenient use, it opens the door to several problems. First, the installation process may compromise the integrity of the waterproofing system that was originally designed for flat-wall construction. The original waterproofing must be carefully modified to prevent water penetration points. If this is not achieved, water damage may result. The liability in this area is, therefore, very high and could lead to extensive repair costs in the event of failure. This is especially true in multi-story applications, such as two-story homes, condominiums, etc.

Second, wood seat framing systems are generally subject to continued shrinkage and subtle movement as members flex to atmospheric conditions. This movement causes considerable and unsightly grout crackage, which requires expensive call-backs to the contractor for repair.

Third, much labor is expended in producing this seat. The seat must be rough-framed; adequately waterproofed; surrounded on all exposed sides with a means of reinforcement for mortar; mortar must then be applied to all exposed sides; and, finally, the seat is tiled and grouted.

Fourth, this system for installation is rarely calculated for a specific stress load. Therefore, the load requirement is estimated, and the contractor must then "guess" how many and what size nails with which to install the support. This opens the door not only to product failure from use, but also subjects the user to potential personal injury and the installer/contractor to extreme liability exposure.

OBJECTS AND ADVANTAGES

It suffices to say that a better method to the system described in the previous section should exist. The invention that I propose will accomplish this goal. The advantages of the structural support frame include the following points:

(A) A pre-calculated stress load that will not vary when used with specified fasteners.

(B) The elimination of an additional waterproofing membrane, as well as the full protection of surrounding waterproofing systems, thereby eliminating the possibility of water seepage to vulnerable framing members.

(C) Providing a structural substrate which is non-conducive to corrosion, dry rot fungus (decay of any nature), movement resulting from atmospheric absorption, or any other natural failure of the intended product in its entirety.

(D) An extremely rapid installation process that is flexibly designed for installation in "new" construction (finish wall tile not yet applied) and "existing" tiled areas as an after-market accessory upgrade.

(E) The elimination of costly wood framing systems (currently in use) such as necessary substrate "backing systems" or multi-member support structures.

(F) The basic cost savings through the elimination of all underside mortar-tile-grout applications.

(G) The provision of a uniform tiling surface for any design conditions.

(H) The convenience of a "stockable" item which is readily available in various sizes and/or shapes.

Further objects and advantages stem from basic product durability and ease of handling. Other advantages will become apparent through a consideration of the ensuing descriptions and drawings.

DRAWING FIGURES

Figure 1:
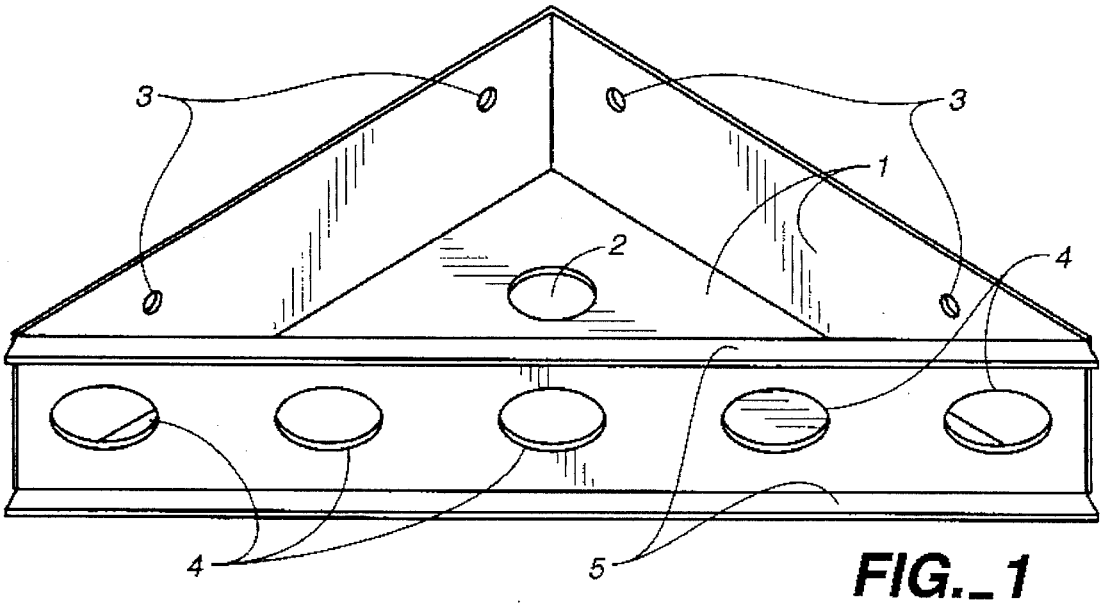
FIG. 1 shows base unit with straight front edge.

| Reference Numerals In Drawings |
|---|
| (1) base unit |
| (2) drain hole |
| (3) mounting holes |
| (4) mortar penetration holes |
| (5) mortar support flange |
| (6) mortar |
| (6a) main body |
| (6b) thin mortar edge |
| (7) tile |
| (8) bonding agent |
| (9) grout |

Figure 2:
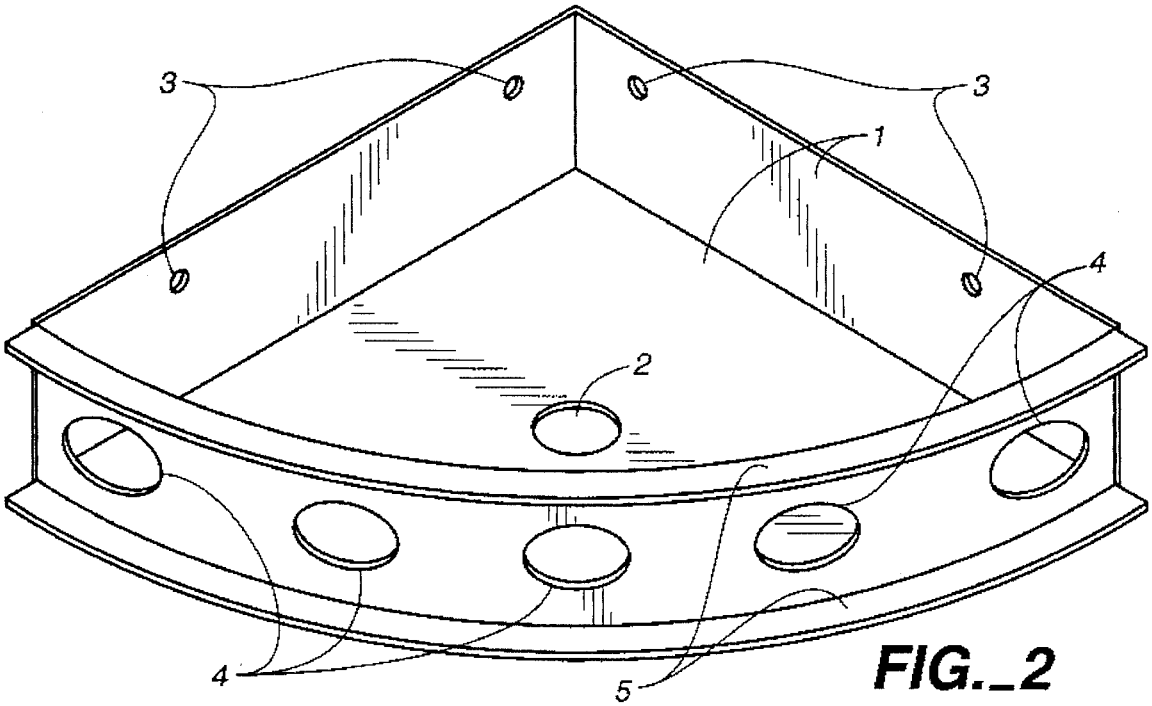
FIG. 2 shows base unit with curved front edge.
Figure 3A:
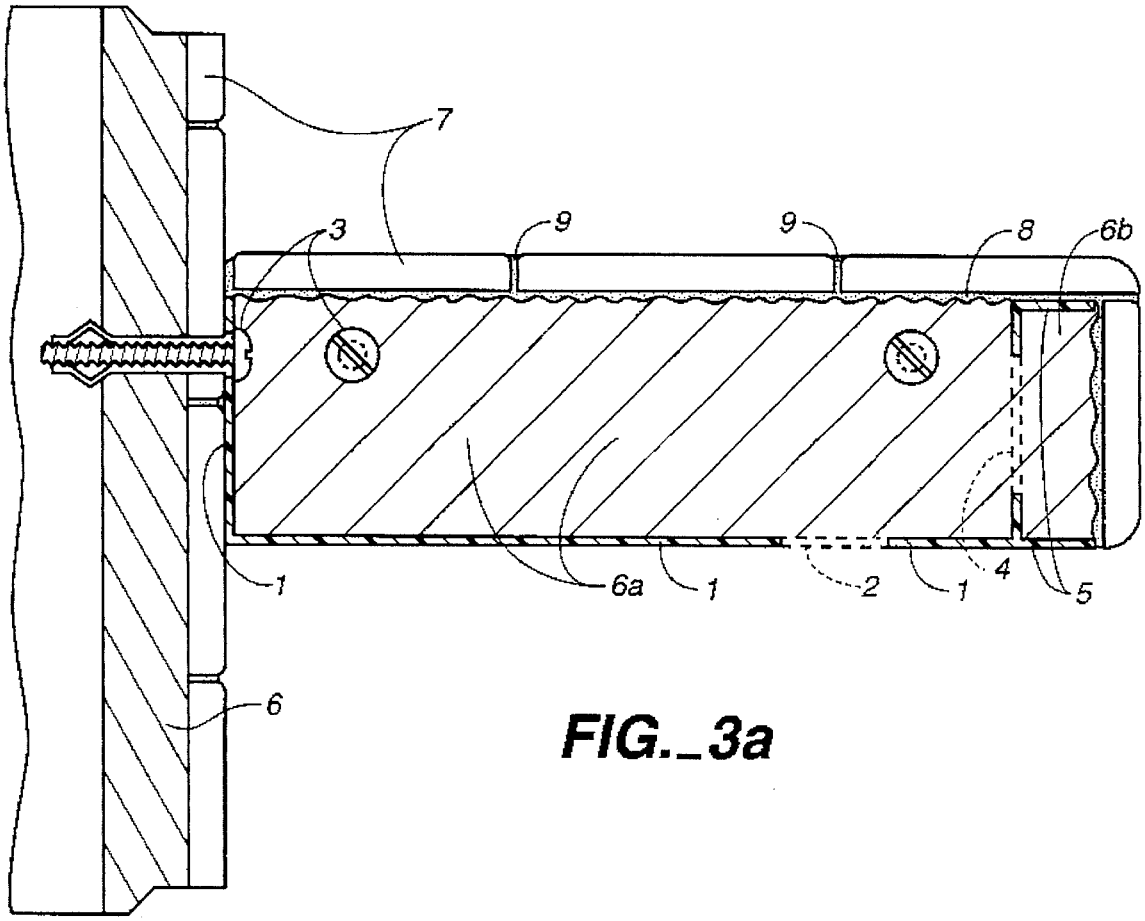
FIG. 3 shows a cross-section view of tiled unit.
Figure 3B:
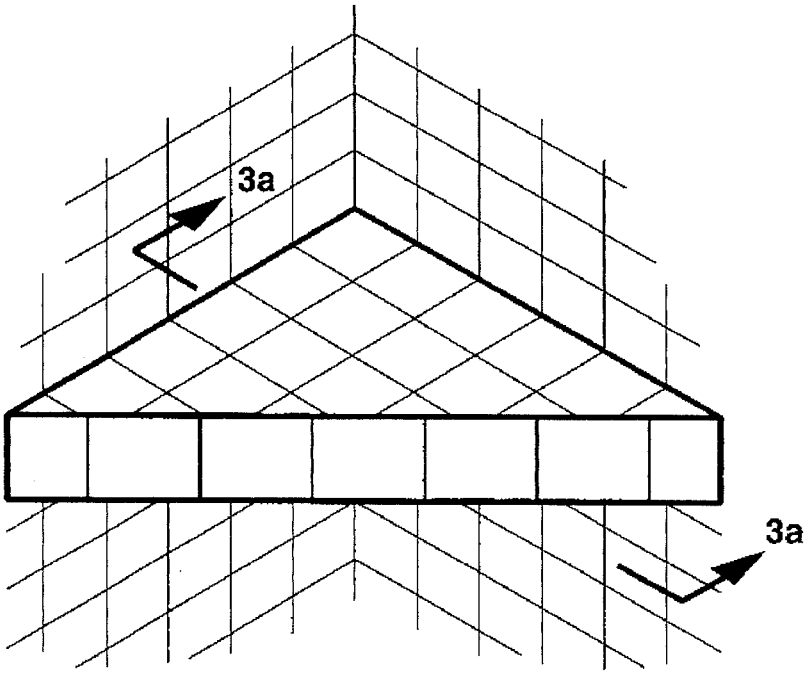

DESCRIPTION—FIGS. 1, 2 and 3

A typical embodiment of the invention is illustrated in FIG. 1 (isometric view of top side as seen from front edge). The invention is one piece, structurally calculated, and made of a non-corrosive, rigid material that is pre-formed to a specific size and shape, called namely the base unit (1).

The base unit (1) can be produced from several materials through various production processes, including: corrosion-resistant sheet metal which can be stamped or folded; aluminum or brass, both of which can be cast, stamped or folded; plastic, through injection molding or otherwise; and various other materials.

A mortar supporting flange (5) is provided at the front edge to allow for gravitational support of uncured mortar, and to form the mortar edge for uniform application of finish tile. This flange may be formed as part of the base unit or applied to the base unit after forming (by soldering, welding, adhesive, rivet, etc.). This thin mortar layer (6*b*) is reinforced by means of mortar penetration holes (4) which allows monolithic adhesion of the applied thin mortar edge (as viewed in FIG. 3) to the heavier main mortar body (6*a*), which is supported in itself by way of the base unit (1).

Mounting holes (3) are provided in specific locations to allow quick and easy fastening of the base unit (1) to structural perpendicular wall elements at any elevation desired. A drain hole (2) is provided to allow any moisture that may penetrate the tile and mortar bed to escape and, thereby, maintaining the integrity of the applied mortar bed.

Additional embodiments are shown in FIGS. 2 and 3. In FIG. 2 the base unit is shown with a variation in shape (not limited to shape shown). FIG. 3 shows a cross-sectional view from one side, either left or right (both views are typical). FIG. 3 shows the base unit (1) with the application of installer-provided mortar in place, as well as a typical illustration of all the finished tile areas as pertains to my stated invention, in a completed form.

There are various possibilities with regard to the shapes, sizes and basic configuration of the invention which are seen when comparing FIGS. 1 and 2. FIG. 1 shows a straight-faced, diagonal form. FIG. 2 shows one of many alternative configurations possible with the "structural support frame". The thickness variations of the mortar bed, as well as size or surface area variations provide design alternatives for the finished tiled surfaces.

From the description above, a number of novel advantages become evident:

(A) The use of a non-corrosive, non porous material virtually eliminates structural failure or subsequent movement.

(B) The elimination of additional waterproofing membranes, as well as the preservation of vertical surface waterproofing membranes greatly reduces the risk of water penetrating to susceptible framing members.

(C) A safe, rapid installation system that not only allows the installer to become more productive, but also provides a less expensive means by which to provide a convenient feature to all consumers.

(D) Allowing the flexibility of installation before or after the completion of the initial tile project.

(E) Allowing a visual aid placement of the seat at any elevation prior to installation for the consumer's visualization and approval.

OPERATION—FIGS. 1, 2, 3

The manner of using this structural support unit for its designed use, listed above, is as follows: (The unit is designed to be mounted prior to project completion, or after the finish wall tiles have been installed and grouted.) The selection of size and shape of the base unit (1) will be made by the consumer. The installer then determines the elevation and/or location for the unit. This can be done simply by moving the unit anywhere until the aesthetic or functional location is found. The mounting hole locations are then marked on the surface of which the base unit is to be installed and drilled with a drill bit of the specified size per the unit. The fasteners are applied through the mounting holes (3), connecting the base unit (1) (see FIG. 1 or 2) to the vertical wall surface(s). The base unit (1) will be filled with moistened mortar mix (6) to the top of the base unit (1), with the allowance for mortar extruding through mortar penetration holes (4). The excess mortar will then be scraped off, level with the top of the base unit (1), to provide a uniform, smooth surface. The mortar extruding through the mortar penetration holes (4) will be added to, as necessary, to provide for complete coverage of the face of the base unit (1) between the mortar support flange (5). The excess mortar between the mortar support flange (5) will be scraped off, flush to the edge of the mortar support flange (5) for its entire length, thereby providing a uniform, smooth surface (as shown in FIG. 3). Mortar (6) is allowed to cure sufficiently prior to application of the finish surface tile (7) and grout (9).

SUMMARY, RAMIFICATIONS, AND SCOPE

Accordingly, the reader will see that the self-supporting base unit of this invention can be utilized in such a fashion as to allow for customization of tile projects by means of a safe, rapid, and flexible system. The invention provides: ease of use; a stable, non-corroding base, which combines the structural component of the seat, with a convenient forming system for mortar applications; substantial savings of installation time through the elimination of several, currently necessary, elements (waterproofing, structural blocking, rough framing, the application of reinforcing material, elimination of any additional surface finishing to the underside of the invention); built-in custom design features, such as shape and size; and a visual aid that most consumers require to understand the full benefit of placement and design.

Although the description above contains many specificities, these should not be construed as limiting the scope of the invention but as merely providing illustrations of some of the presently preferred embodiments of this invention. Examples can range from shapes other than those shown; mortar penetration holes of different configuration or spacings; a mortar support flange of varying size or elevation; fastening systems for different surfaces, etc., as well as the possibility of using the invention without mortar and tile by inversion of the base unit.

Thus the scope of the invention should be evaluated by the appended claims and their legal equivalents, rather than by the examples I have offered here.

I claim the structural support frame as:

1. A structural support frame for ceramic tile corner seats and service trays comprising in combination:

a base unit (1) having a plurality of interface walls for abutting with structural walls, said interface walls each engaged to and extending perpendicular from a horizontal floor member in a first horizontal plane, and a frontal wall engaged to and extending perpendicularly from said horizontal floor member with opposite terminal ends of said frontal wall each engaged to a terminal end of one of said interface walls, whereby said interface walls, said frontal wall and said horizontal floor member form an internal cavity for receiving a supply of mortar;

a first flange (5) extending about a first longitudinal front edge of said frontal wall for gravitational support of uncured mortar and to form a uniform edge for application of finish tile;

mortar penetration holes (4) within said frontal wall to provide for monolithic adhesion of mortar applied about the mortar supporting flange and said front wall; and mounting holes (3) within said interface walls to receive fastening means for securely fastening the base unit to said structural walls extending substantially perpendicular to said horizontal floor of the base unit and parallel to said interface walls.

2. The structure support frame of claim 1 wherein, said interface walls, said frontal wall and said horizontal floor member are integrally engaged to form said internal cavity.

3. The structural support frame of claim 2 further including, a second flange extending about a second longitudinal front edge of said front wall and parallel with the first flange to form a second uniform edge for application of finish tile.

4. The structural support frame of claim 3 further including, a drain hole (2) within said horizontal floor member to allow for escape of penetrating moisture within said cavity.

5. The structural support frame of claim 4 wherein, said interface walls and said frontal wall all extend vertically from said horizontal floor at a uniform height with terminal edges of said interface walls and said frontal wall establishing a second horizontal plane above said cavity and parallel with said first horizontal plane, whereby mortar may be received in said cavity to a capacity coinciding with said terminal edges and tile adhered to said mortar and parallel with said second horizontal plane.

6. The structure support frame of claim 5 wherein, the first flange and second flange each extend horizontally and parallel to said second horizontal plane.

7. The structure support frame of claim 6 wherein, said frontal wall is arcuate.

* * * * *